US007234896B2

(12) United States Patent
Donnally et al.

(10) Patent No.: US 7,234,896 B2
(45) Date of Patent: Jun. 26, 2007

(54) VERTICALLY FOLDING SERVICE ARM FOR A MOVABLE PLATFORM OFFSHORE DRILLING OR SERVICING RIG

(75) Inventors: Robert B. Donnally, Shanghai (CN); Neil E. Fehres, Sugarland, TX (US)

(73) Assignee: National-Oilwell, L.P., Houston, TX (US)

( * ) Notice: Subject to any disclaimer, the term of this patent is extended or adjusted under 35 U.S.C. 154(b) by 27 days.

(21) Appl. No.: 11/247,371

(22) Filed: Oct. 11, 2005

(65) Prior Publication Data

US 2006/0078406 A1 Apr. 13, 2006

Related U.S. Application Data

(60) Provisional application No. 60/618,022, filed on Oct. 12, 2004.

(51) Int. Cl.
*E02B 17/00* (2006.01)

(52) U.S. Cl. ..... 405/201; 405/195.1

(58) Field of Classification Search ..... 405/195.1, 405/201; 166/338, 341; 248/125.2, 332
See application file for complete search history.

(56) References Cited

U.S. PATENT DOCUMENTS 4,081,932 A * 4/1978 Armstrong ..... 52/111
4,208,158 A * 6/1980 Davies et al. ..... 414/22.68
4,668,127 A * 5/1987 Steele ..... 405/198
5,492,436 A * 2/1996 Suksumake ..... 405/201
6,161,358 A * 12/2000 Mochizuki et al. ..... 52/651.05

OTHER PUBLICATIONS

Drawings of a Prior Art Horizontal Plane Service Arm (Jul. 31, 1993).
Drawings of a Prior Art Horizontal Plane Service Arm (Mar. 17, 1990).
The PCT International Search Report and The Written Opinion of the International Search Authority, dated Mar. 14, 2007 of PCT Application Serial No. PCT/US05/36528, filed Oct. 12, 2005.

* cited by examiner

*Primary Examiner*—Frederick L. Lagman
(74) *Attorney, Agent, or Firm*—Howrey LLP

(57) ABSTRACT

An apparatus and method for maintaining electrical and hydraulic connections between a junction box (or junction boxes) located on or near an offshore platform's floor and a movable drilling rig structure are disclosed. The disclosed invention is a unique vertically folding service arm capable of moving in both the horizontal and vertical directions in order to provide enhanced range of movement. The increased range of movement provided by the vertically folding service arm of the present invention allows electrical and hydraulic supply lines to remain connected between a junction box (or boxes) located on or near the platform floor and the rig structure even as the rig structure moves back-and-forth on the platform between multiple well centers. The vertically folding service arm of the present invention can also be easily disconnected and "folded" for transport without requiring the electrical and hydraulic supply lines to be disconnected from the drilling rig structure.

37 Claims, 5 Drawing Sheets

VERTICALLY FOLDING SERVICE ARM FOR A MOVABLE PLATFORM OFFSHORE DRILLING OR SERVICING RIG

This application claims the benefit of U.S. Provisional Application No. 60/618,022, filed Oct. 12, 2004.

FIELD OF THE INVENTION

The present invention relates to a vertically folding service arm for use on movable platform drilling or servicing rigs used in offshore production of oil and gas reserves. In particular, the invention relates to a unique service arm capable of moving in both the horizontal and vertical directions in order to provide enhanced range of movement that allows electrical and hydraulic supply lines to remain connected between a junction box on or near the platform floor and the rig structure even as the rig structure moves back-and-forth on the platform between multiple well centers.

BACKGROUND OF THE INVENTION

Because of the tremendous expense associated with drilling for oil and gas offshore, oil and gas companies have developed ways to spread the expense associated with manufacturing offshore drilling equipment over a larger number of wells. Typically, in exploring for oil and gas reserves offshore, an exploratory well is drilled with a drill ship or a jack-up rig to determine if the potential oil and gas field is large enough to justify the tremendous expense of manufacturing, assembling, and locating a drilling platform offshore.

If the oil and gas reserves are large enough, a drilling and production platform will be placed over the field. These platforms utilize a movable rig structure that moves back-and-forth along the platform such that multiple wells can be drilled from one platform. After the wells have been drilled, the platform is used to produce oil and gas from these multiple wells.

Over the producing life of the field, it often becomes necessary to perform certain maintenance operations as well as certain stimulation operations aimed at stimulating production from the wells. The drilling rig structure on the platform can be moved over a specific well to perform these servicing operations.

To perform the various operations required of the drilling rig structure, the rig structure must be connected to an electrical power source and a hydraulic fluid supply source. Maintaining connections to these sources, however, has proven difficult in the past with movable drilling rig structures on offshore platforms. Specifically, the prior art "horizontal plane" service arms had a limited range of motion, and, thus, it was difficult to get an extended reach with these horizontal service arms. Often, when using the prior art horizontal service arms, the range of movement of these arms was limited by equipment on the platform and/or drilling rig structure blocking the horizontal service arm from moving in a specific direction. Additionally, preparing the prior art horizontal service arms for transport required disconnecting the electrical and hydraulic supply line connections, thereby increasing the amount of time it takes to prepare the platform for operations once it reaches its offshore destination.

Similarly, prior art "drag chains" suffer from the same limitations as the horizontal service arms. As the name implies, the prior art drag chains are used to drag the supply lines across the platform floor to maintain the connections. Obviously, dragging chains and supply lines across a platform floor that has a significant amount of equipment on it has some limitations. Further, the use of drag chains is a very time consuming process that requires up to a days worth of work to move the supply lines to the drilling rig structures new drilling location. The current invention is designed to alleviate these and other known problems associated with the prior art.

Accordingly, what is needed is a means for maintaining the electrical and hydraulic connections between a junction box or boxes located on or near the platform floor and the drilling rig structure as the drilling rig moves back and forth along the platform. It is, therefore, an object of the present invention to provide a vertically folding service arm capable of moving in both the horizontal and vertical directions in order to provide enhanced range of movement that allows electrical and hydraulic supply lines to remain connected between a junction box located on or near the platform floor and the rig structure even as the rig structure moves back-and-forth on the platform between multiple well centers. It is a further object of the present invention to provide a service arm that can be easily disconnected and "folded" for transport without requiring the electrical and hydraulic supply lines to be disconnected from the drilling rig structure. Those and other objectives will become apparent to those of skill in the art from a review of the specification below.

SUMMARY OF THE INVENTION

An apparatus and method for maintaining electrical and hydraulic connections between a junction box (or junction boxes) located on or near a platform floor and a movable drilling rig structure are disclosed. The disclosed invention is a unique vertically folding service arm capable of moving in both the horizontal and vertical directions in order to provide enhanced range of movement.

The vertically folding service arm of the present invention consists of multiple sections hingedly connected together such that the service arm can "fold" in the vertical plane. The service arm is supported by a rotating support post on one end and utilizes a winch/wireline system that stabilizes the support post by removing the horizontal component of the force acting on the top of the support post so that the weight of the service arm does not tip the post over when the service arm is in operation. On the opposite end, the service arm is connected to the drilling rig structure by a pivoting connector that allows the service arm to move in both the horizontal and vertical planes.

The increased range of movement provided by the vertically folding service arm of the present invention allows electrical and hydraulic supply lines to remain connected between a junction box (or boxes) located on or near the platform floor and the rig structure even as the rig structure moves back-and-forth on the platform between multiple well centers. The vertically folding service arm of the present invention can also be easily disconnected and "folded" for transport without requiring the electrical and hydraulic supply lines to be disconnected from the drilling rig structure.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

In FIG. 2, the vertically folding service arm is shown in the vertically "folded" position required by the location of the movable drilling rig structure over the well center nearest the junction box (or boxes) located on or near the platform floor.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
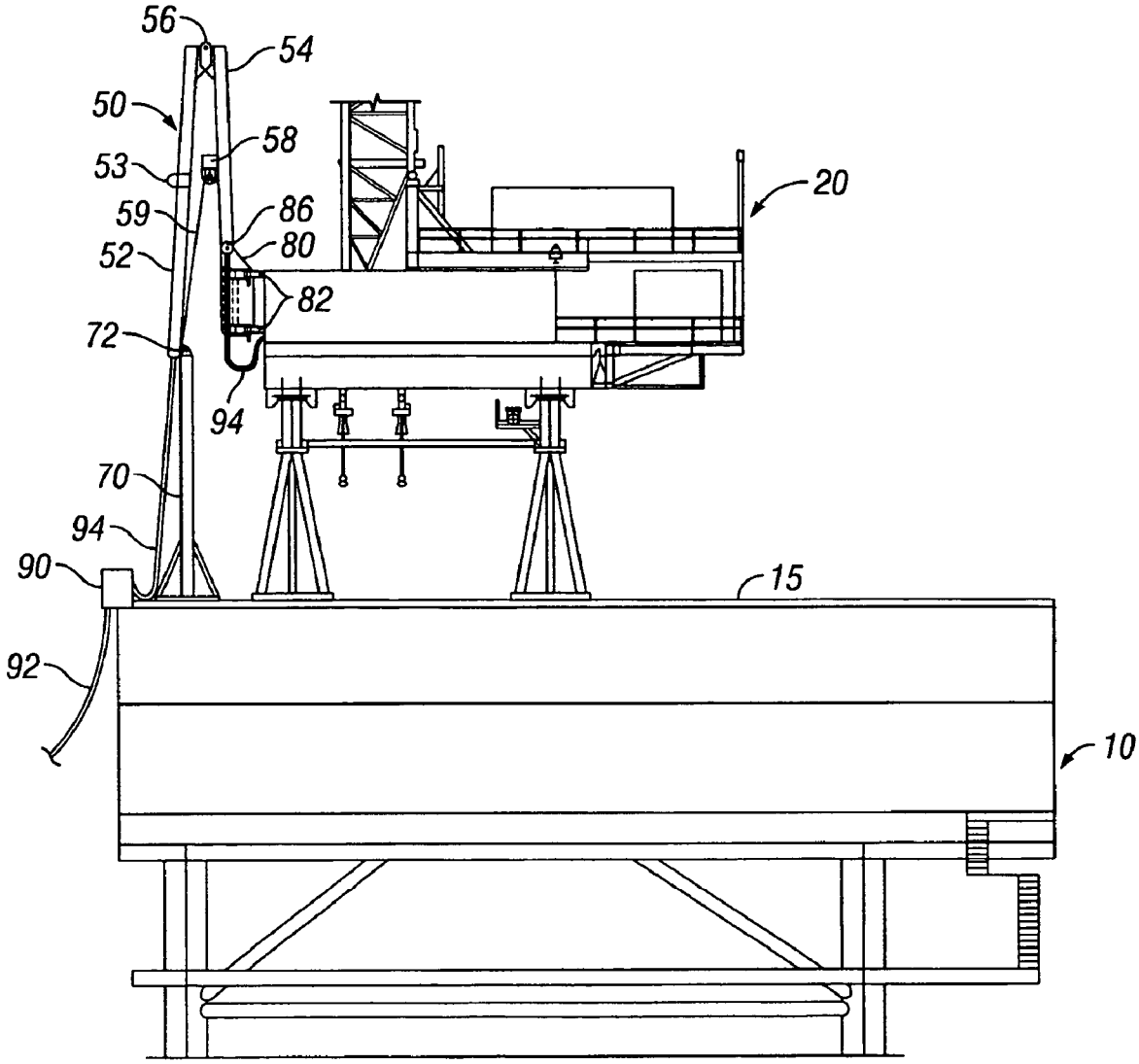
FIG. 1 is a side view of a vertically folding service arm mounted on the floor of a stationary offshore drilling and production platform in accordance with one embodiment of the present invention.

Referring to FIG. 1, a vertically folding service arm 50 is shown mounted on the floor 15 of an offshore drilling and production platform 10. As shown in FIG. 1, service arm 50 is connected to support post 70 on one end and to the drilling rig structure 20 (via pivoting connector 80) on the other end.

In operation, rig structure 20 can be moved by sliding it along rails on the platform floor 15 until rig structure 20 is over the specific well in which drilling or service operations are to be performed. For larger platforms, drilling and production operations may be conducted on dozens of wells. On these larger platforms, rig structure 20 can move in both the left and right directions (when looking at FIG. 1) as well as in the forward and backward direction (along the axis extending through the page when looking at FIG. 1). As rig structure 20 moves back and forth along platform floor 15, service arm 50 allows a range of movement that is capable of maintaining the connection of supply lines 94 to junction box 90 and to rig structure 20.

Figure 2:
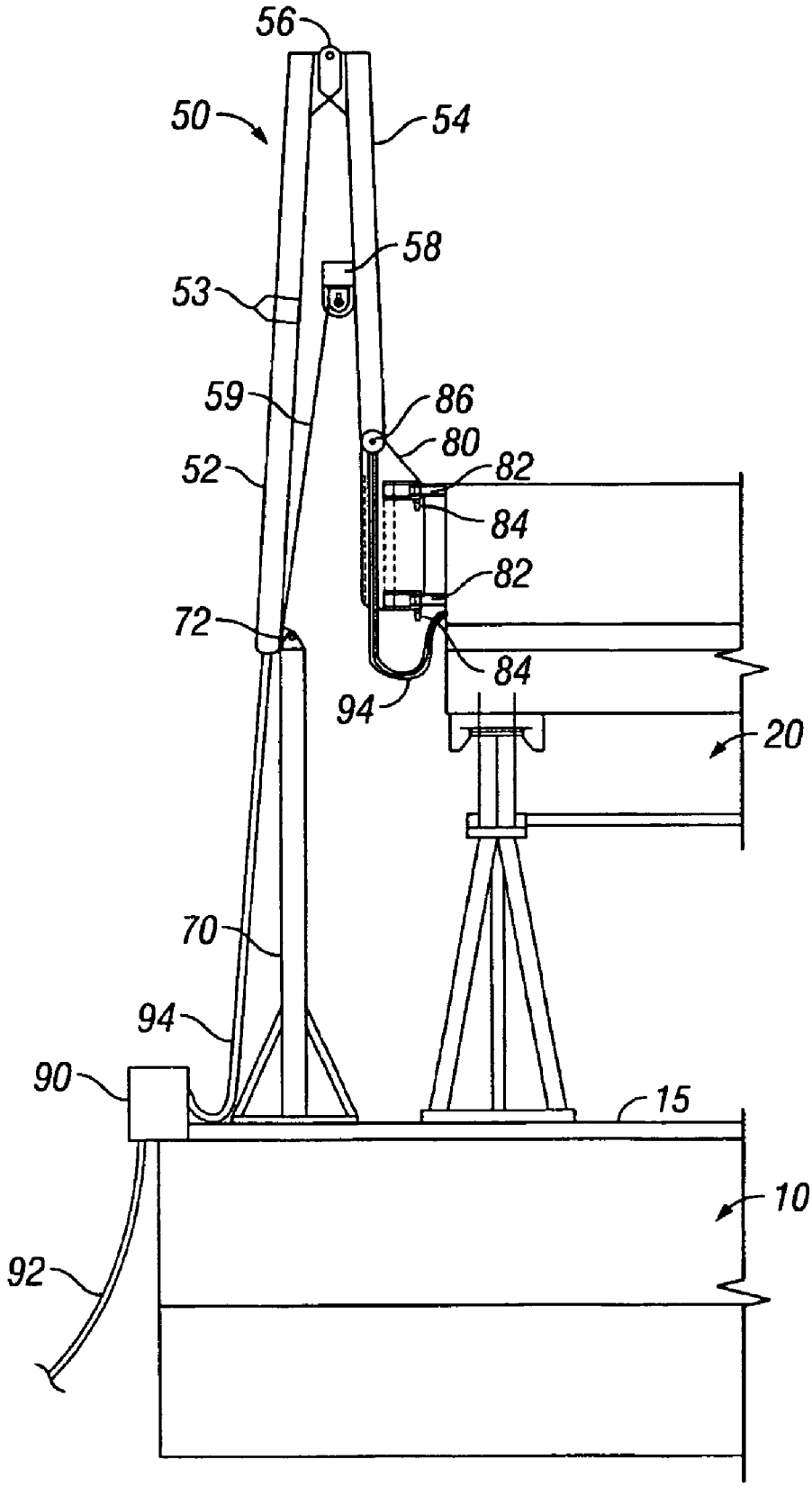
FIG. 2 is a close-up side view of the vertically folding service arm shown in FIG. 1.

Specifically, when rig structure 20 is located on the well center nearest to junction box 90, service arm 50 is in the "folded" position shown in more detail in FIG. 2. As can be seen in FIG. 2, a first section 52 of service arm 50 is connected on one end to support post 70 via pivoting joint 72. In the preferred embodiment of the present invention, support post 70 rotates to help account for the forward and backward movement of rig structure 20, while pivoting joint 72 allows for the pivoting of service arm 50 as the service arm is either "folded" or "extended" in the vertical plane due to the movement of rig structure 20 in the left and right directions. In an alternative embodiment, support post 70 is stationary, and pivoting joint 72 is a universal joint that allows for both rotation of service arm 50 as well as the pivoting of service arm 50.

First section 52 of service arm 50 is connected to a second section 54 of service arm 50 through vertical hinge 56. Vertical hinge 56 allows service arm 50 to either "fold" or "extend" in response to movement of rig structure 20. Second section 54 is equipped with a winch 58 and wireline 59 that are used to stabilize support post 70 so that the weight of service arm 50 does not "tip" support post 70 over during operation. Winch 58 is controlled such that wireline 59 exerts a "pulling" force on the top of support post 70 to counter the horizontal component of the force "pushing" on support post 70 as service arm 50 is extended. In this way, the horizontal forces acting on support post 70 as the service arm 50 is folded and/or extended can be controlled.

In the preferred embodiment, first section 52 and second section 54 of service arm 50 comprise two parallel sides that can be constructed of standard steel beams. Running between and connecting the parallel sides of service arm 50 are a series of cable trays or "ladder rung" supports that are used to organize and support the electrical and hydraulic supply lines 94 carried by service arm 50. One of skill in the art will appreciate that service arm 50 can be made out of any material that has sufficient strength to support the weight of service arm 50 when extended and the weight of the supply lines 94. Further, one of skill in the art will appreciate that the sides of service arm 50 do not have to be parallel to achieve the objects of the present invention so long as the sides are spaced apart in such a way to allow for cable trays or ladder rung supports to be connected between the sides.

Additionally, first section 52 of vertically folding service arm 50 is equipped with a lifting lug 53 that is designed to receive a wireline from a crane that can be used to lift service arm 50 for installation or for disconnecting service arm 50 for storage during transport or during periods of inactivity.

FIG. 2 also shows conduit 92 connected to junction box 90 on the platform floor 15. Conduit 92 is run from the electrical power source and the hydraulic fluid source located elsewhere on the platform 10 to junction box 90. Supply lines 94 are run from junction box 90 through service arm 50 to the rig structure 20. Supply lines 94 comprise the electrical and hydraulic supply lines that supply power and hydraulic fluid to rig structure 20. Conduit 92 and supply lines 94 are connected to junction box 90 through any suitable connection means known in the art.

Although FIG. 2 shows a single junction box 90, one of skill in the art will appreciate that multiple junction boxes 90 for the various supply lines 94 (i.e., for the electrical power supply cables and the hydraulic fluid supply hoses) can be utilized. Regardless of whether one junction box or multiple junction boxes are used, the supply lines 94 are all run through and supported by service arm 50 such that they can be connected to rig structure 20.

Figure 3:
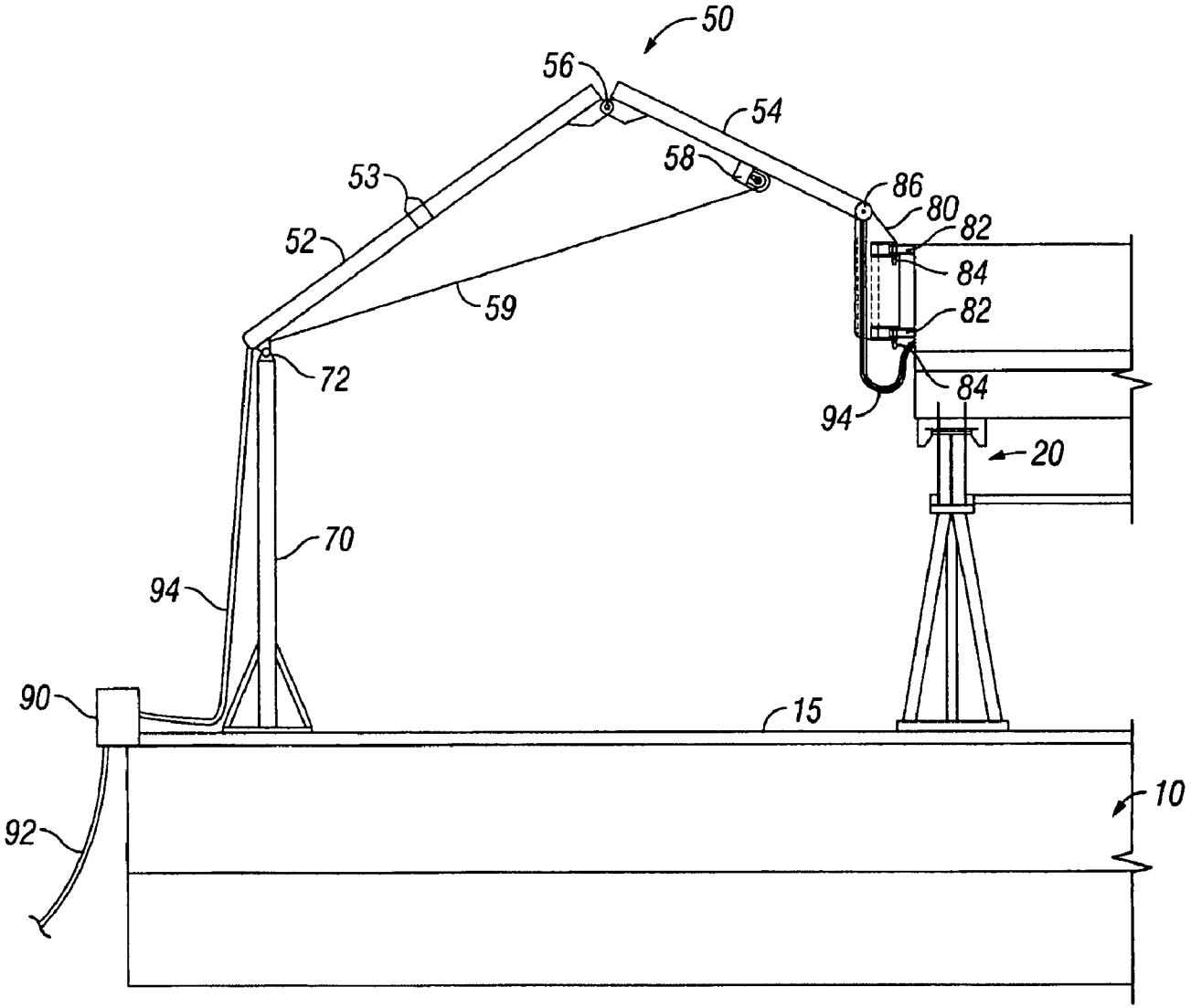
FIG. 3 is a close-up side view of the vertically folding service arm of the present invention shown in the "extended" position required by the location of the movable drilling rig structure over a well center further removed from the junction box (or boxes) located on or near the platform floor.

FIG. 3 shows service arm 50 extended outwardly from support post 70 as rig structure 20 has moved over a well center further from junction box 90. As service arm 50 is extended, winch 58 controls the extension of wireline 59 such that the horizontal force acting on support post 70 is minimized. Service arm 50 is capable of extending through the combined action of pivoting joint 72, vertical hinge 56, and pivoting joint 86 (connected to pivoting connector 80). As service arm 50 is extended, pivoting joint 72 and pivoting joint 86 rotate around their connection points to support post 70 and to pivoting connector 80 respectively, while at the same time, vertical hinge 56 "opens" to allow first section 52 and second section 54 to move within the vertical plane. Similarly, the rotation of support post 70, in conjunction with the pivoting of pivoting connector 80 (discussed in more detail with reference to FIG. 4), accounts for the necessary movement of service arm 50 in the horizontal plane.

Figure 4:
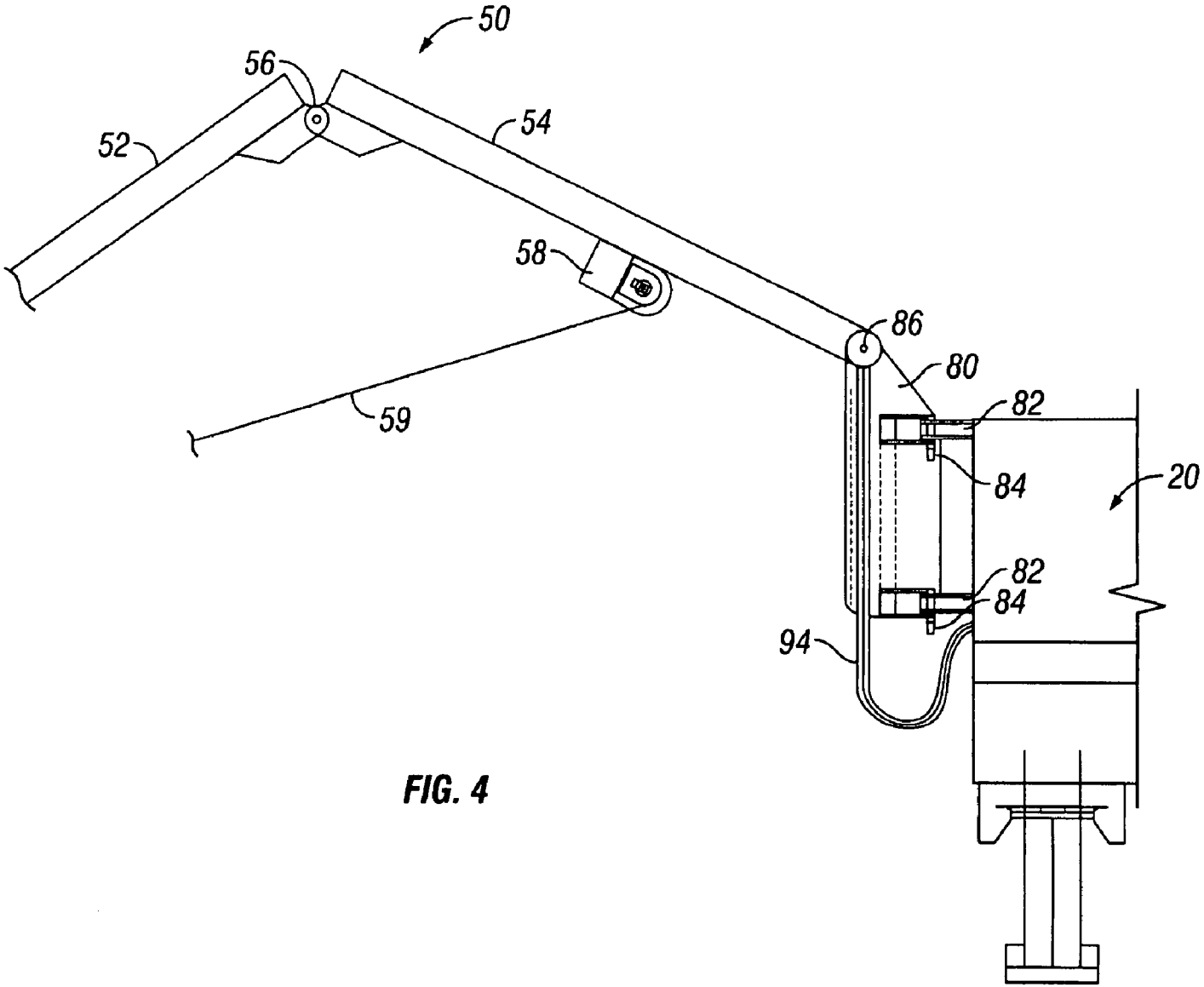
FIG. 4 is a close-up side view of the connection point of the vertically folding service arm to the movable drilling rig structure according to one embodiment of the present invention.

Referring now to FIG. 4, to help accommodate the vertical and horizontal movement of service arm 50, pivoting connector 80 is used to connect service arm 50 to rig structure 20. Pivoting connector 80 is designed to rotate in the horizontal plane. In the preferred embodiment, support beams 82 are connected to rig structure 20 such that they extend outwardly from rig structure 20 at the point where service arm 50 will be connected. Pivoting connector 80 is pinned to the support beams 82 via vertical pins 84 such that pivoting connector 80 can rotate about the vertical pins 84 in the horizontal plane. Service arm 50 is connected to the pivoting connector 80 via pivoting joint 86 that allows service arm 50 to rotate about the connection point to the pivoting connector 80 thereby allowing service arm 50 to move in the vertical plane.

FIG. 4 also shows supply lines 94 carried through service arm 50 to their connection points along rig structure 20. Supply lines 94 are connected to equipment on rig structure 20 by any suitable connection means known in the art.

Figure 5:
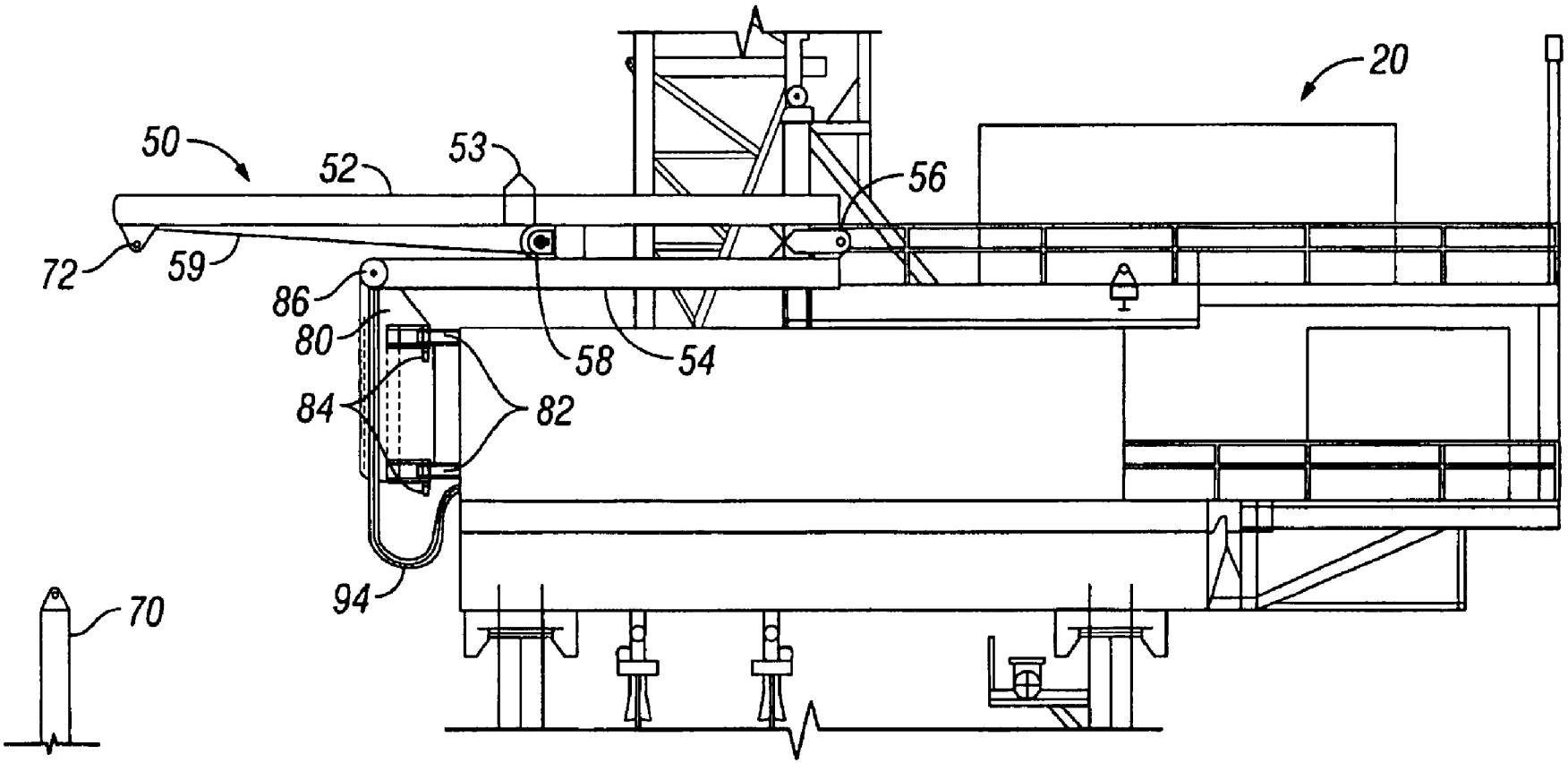
FIG. 5 is a side view of the vertically folding service arm in the stored position according to one embodiment of the present invention.

FIG. 5 shows service arm 50 in the stored position. In order to store service arm 50 during transportation of platform 10 to its offshore operating position or during periods of inactivity, service arm 50 can be disconnected from support post 70 and folded by "closing" vertical hinge 56. Supply lines 94 are disconnected from junction box 90 and can be placed on service arm 50 for storage. The opposite ends of supply lines 94 that are connected to rig structure 20 do not, however, have to be disconnected. As can be seen in FIG. 5, in the stored position, service arm 50 is placed on rig structure 20 such that supply lines 94 can remain connected to their connection points on rig structure 20. By allowing supply lines 94 to remain connected to the rig structure 20 when service arm 50 is placed in the stored position, the amount of time required to install service arm 50 and to restore the electrical and hydraulic connections between junction box 90 and rig structure 20 is significantly reduced.

While the apparatus, compositions and methods of this invention have been described in terms of preferred or illustrative embodiments, it will be apparent to those of skill in the art that variations may be applied to the apparatus and methods described herein without departing from the concept and scope of the invention. All such similar substitutes and modifications apparent to those skilled in the art are deemed to be within the scope and concept of the invention as it is set out in the following claims.

The invention claimed is:

1. An apparatus for maintaining a connection to a movable rig structure on a platform comprising:

a support post having a first end and a second end;

a first arm having a first end and a second end, wherein the first end is operatively connected to the second end of the support post such that the first arm is adapted for movement in a vertical plane;

a second arm having a first end and a second end, wherein the first end of the second arm is operatively connected to the second end of the first arm and the second end of the second arm is operatively connected to the movable rig structure, the second arm being adapted for movement in a vertical plane and in a horizontal plane;

a winch connected to the second arm;

a wireline extending from the winch to the second end of the support post; and at least one supply line wherein the at least one supply line is supported by the first arm and the second arm such that the at least one supply line extends from the support post to the movable rig structure.

2. The apparatus of claim 1 wherein a connector operatively connects the second end of the second arm to the movable rig structure, the connector comprising one or more vertical pins adapted to allow the connector to move in a horizontal plane.

3. The apparatus of claim 1 wherein the winch and wireline are adapted to reduce the forces acting on the support post that are created by the movement of the first arm and the second arm in the vertical plane.

4. The apparatus of claim 3 wherein the second end of the first arm is operatively connected to the first end of the second arm by a hinge.

5. The apparatus of claim 4 wherein opening of the hinge extends the second arm away from the first arm.

6. The apparatus of claim 1 wherein the first end of the first arm is operatively connected to the second end of the support post by a universal joint that is adapted for movement of the first arm in both a horizontal plane and a vertical plane.

7. The apparatus of claim 1 wherein the support post is connected to the platform and is adapted to rotate.

8. The apparatus of claim 7 wherein the first end of the first arm is operatively connected to the second end of the support post by a pivoting joint.

9. The apparatus of claim 1 further comprising at least one junction box, wherein a first end of the at least one supply line is connected to the at least one junction box.

10. The apparatus of claim 9 further comprising a conduit connected to the at least one junction box, the conduit connecting electrical and hydraulic supply lines to the junction box.

11. The apparatus of claim 2 wherein the connector is operatively connected to the second end of the second arm by a pivoting joint adapted to allow the second arm to rotate in a vertical plane.

12. The apparatus of claim 11 wherein the first arm is adapted to be detached from and reattached to the support post.

13. The apparatus of claim 12 wherein the first arm further comprises a lifting lug.

14. The apparatus of claim 13 wherein the apparatus is adapted for storage on the movable rig structure by closing the hinge between the first arm and the second arm and rotating the apparatus about the pivoting joint between the second arm and the connector.

15. The apparatus of claim 1 wherein the first arm and the second arm each comprise two sides and one or more cable trays extending between the two sides of each arm.

16. The apparatus of claim 15 wherein the one or more cable trays of each arm support the at least one supply line.

17. The apparatus of claim 1 wherein the first arm and the second arm each comprise two sides and a plurality of rungs extending between the two sides of each arm.

18. The apparatus of claim 17 wherein the plurality of rungs support the at least one supply line.

19. The apparatus of claim 1 further comprising multiple supply lines having first and second ends, wherein the supply lines pass through the length of the first arm and through the length of the second arm, and wherein the second ends of the multiple supply lines are connected to the movable rig structure.

20. A vertically folding service arm for use on a drilling platform, the service arm comprising:

a support post connected to the drilling platform, wherein the support post is adapted to rotate;

a first portion of the service arm operatively connected to the support post such that the first portion of the service arm is adapted for movement in a vertical plane and such that the service arm may be detached from the support post and lifted onto the movable rig to be stored;

a second portion of the service arm, wherein the second portion of the service arm is operatively connected to the first portion of the service arm such that the service arm can extend away from the support post;

a winch mounted on the second portion of the service arm and a wireline extending from the winch to the support post, wherein the winch and wireline are adapted to reduce the forces acting on the support post that are created by extension of the service arm away from the support post;

a connector operatively connecting the second portion of the service arm to a rig that is movable on the drilling platform such that the second portion of the service arm is adapted for movement in both a vertical plane and a horizontal plane.

21. The service arm of claim 20 wherein the first portion and the second portion of the service arm each comprise two sides and one or more cable trays extending between the two sides of each portion of the service arm.

22. The apparatus of claim 20 wherein the first portion and the second portion of the service arm each comprise two sides and a plurality of rungs extending between the two sides of each potion of the service arm.

23. The service arm of claim 20 further comprising a lug attached to the service arm.

24. The service arm of claim 23 wherein a wireline from a crane is connected to the lug to lift the service arm onto the rig.

25. The service arm of claim 20 further comprising at least two support beams connected to the rig.

26. The service arm of claim 25 wherein the connector is operatively connected to the at least two support beams such that the connector is adapted for movement in a horizontal plane.

27. The service arm of claim 26 wherein the connector is operatively connected to the at least two support beams by one or more vertical pins.

28. A method of connecting a supply line to a moveable rig on a platform comprising:

operatively connecting a first arm to a support post such that the first arm is adapted for movement in a vertical plane;

operatively connecting a first end of a second arm to the first arm and operatively connecting a connector to a second end of the second arm such that the second arm is adapted for movement in the vertical plane;

operatively connecting the connector to the moveable rig such that the second arm is adapted for movement in a horizontal plane; and operatively connecting a supply line to the mobile rig such that the supply line extends from the platform and is supported by the first arm and the second arm.

29. The method of claim 28 further comprising operatively connecting a winch and wireline to the second arm such that the wireline extends from the winch to the support post.

30. The method of claim 29 wherein the support post is connected to the platform and is adapted to rotate.

31. The method of claim 29 wherein the first arm is operatively connected to the support post by a universal joint that is adapted to allow the first arm to move in both a horizontal plane and a vertical plane.

32. The method of claim 30 wherein the first arm is operatively connected to the second arm by a hinge.

33. The method of claim 32 further comprising the step of opening the hinge to extend the second arm away from the first arm.

34. A method of storing a service arm on a moveable rig of a platform comprising:

detaching one or more supply lines from a junction box, the one or more supply lines extending from the junction box to the movable rig and supported by a first portion of the service arm and a second portion of the service arm;

bringing together the first portion of the service arm and the second portion of the service arm by closing a hinge connecting the first portion to the second portion;

detaching the first portion of the service arm from a support post connected to the platform;

vertically rotating the service arm about a pin, wherein the pin operatively connects the second portion of the service arm to a connector that is attached to the moveable rig; and storing the service arm on the moveable rig.

35. The method of claim 34 wherein the first portion of the service arm further comprises a lug.

36. The method of claim 35 further comprising the step of lifting the service arm with a crane having a wireline connected to the lug.

37. The method of claim 36 wherein the one or more supply lines are connected to the moveable rig while the service arm is stored on the moveable rig.

* * * * *

UNITED STATES PATENT AND TRADEMARK OFFICE

CERTIFICATE OF CORRECTION

PATENT NO. : 7,234,896 B2
APPLICATION NO. : 11/247371
DATED : June 26, 2007
INVENTOR(S) : Robert B. Donnally and Neil E. Fehres It is certified that error appears in the above-identified patent and that said Letters Patent is hereby corrected as shown below:

In Claim 22:

Column 7, line 36, “potion” should be changed to --portion--.

Signed and Sealed this

Fourth Day of September, 2007

JON W. DUDAS
*Director of the United States Patent and Trademark Office*